US008336960B2

(12) United States Patent
Lin

(10) Patent No.: US 8,336,960 B2
(45) Date of Patent: Dec. 25, 2012

(54) ROCKING CHAIR

(76) Inventor: Chang-Chen Lin, Tainan County (TW)

( * ) Notice: Subject to any disclaimer, the term of this patent is extended or adjusted under 35 U.S.C. 154(b) by 156 days.

(21) Appl. No.: 13/007,636

(22) Filed: Jan. 16, 2011

(65) Prior Publication Data

US 2012/0153692 A1 Jun. 21, 2012

(30) Foreign Application Priority Data

Dec. 17, 2010 (TW) ..... 99224492 U

(51) Int. Cl.
*A47C 3/02* (2006.01)
*A47C 3/03* (2006.01)

(52) U.S. Cl. ..... 297/270.1; 297/270.2; 297/270.3; 297/270.4; 297/273; 297/281

(58) Field of Classification Search ..... 297/270.1, 297/270.2, 270.3, 270.4, 273, 281
See application file for complete search history.

(56) References Cited

U.S. PATENT DOCUMENTS 2,283,000 A * 5/1942 Feldman ..... 297/273 X
2,302,387 A * 11/1942 Greeno et al. ..... 248/370
3,325,137 A * 6/1967 Knudsen ..... 297/273 X
4,108,415 A * 8/1978 Hauray et al. ..... 297/273 X
4,536,029 A * 8/1985 Rogers, Jr. ..... 297/281
4,591,205 A * 5/1986 James ..... 297/281 X
4,615,059 A * 10/1986 Darowski ..... 297/273 X
4,700,920 A * 10/1987 Horn ..... 297/281 X
5,248,120 A * 9/1993 Brien ..... 297/281 X
5,344,214 A * 9/1994 Trent ..... 297/270.2
5,427,433 A * 6/1995 Holobaugh, Jr. ..... 297/273
5,558,397 A * 9/1996 Chang ..... 297/281
5,630,646 A * 5/1997 Trimble ..... 297/281
5,653,505 A * 8/1997 Holobaugh, Jr. ..... 297/273
5,667,273 A * 9/1997 Noll ..... 297/273 X
5,704,686 A * 1/1998 May ..... 297/281
5,765,913 A * 6/1998 LaPointe et al. ..... 297/281
5,931,530 A * 8/1999 Liu ..... 297/270.3
5,947,557 A * 9/1999 Bellefleur ..... 297/281
5,988,753 A * 11/1999 Lin ..... 297/281 X
6,059,367 A * 5/2000 Rogers ..... 297/281 X
6,092,870 A * 7/2000 Desnoyers et al. ..... 297/281
6,120,094 A * 9/2000 Parent ..... 297/270.1
6,213,551 B1 * 4/2001 Desnoyers et al. ..... 297/270.4
6,244,658 B1 * 6/2001 Parent et al. ..... 297/270.1
6,402,242 B1 * 6/2002 Bellefleur ..... 297/270.1
6,402,243 B1 * 6/2002 Liu ..... 297/281
6,406,095 B1 * 6/2002 Bouchard et al. ..... 297/281
6,464,295 B1 * 10/2002 Bergeron et al. ..... 297/270.4
6,588,841 B1 * 7/2003 Hoffman et al. ..... 297/270.3
6,695,401 B1 * 2/2004 Noll ..... 297/281
6,722,734 B2 * 4/2004 Bellefleur ..... 297/270.1
6,997,510 B2 * 2/2006 Guillot et al. ..... 297/270.1
7,090,295 B2 * 8/2006 Bodinek ..... 297/273

(Continued)

*Primary Examiner* — Rodney B White

(57) ABSTRACT

A rocking chair includes a fixed base having a base portion located on the ground. The base portion includes front and rear sides spaced in a rocking direction. A connecting frame extends upright from the base portion and has a receiving space receiving a rocking mechanism. The rocking mechanism includes a bottom plate, a strut, and front and rear rocking members. The strut extends upright from the bottom plate and is fixed to a seat. Upper ends of the front and rear rocking members are pivotably connected to the connecting frame. Lower ends of the front and rear rocking members are pivotably connected to front and rear ends of the bottom plate. The rocking mechanism is rockable in the receiving space in the rocking direction relative to the fixed base. A positioning mechanism controls the rocking mechanism to be in a rockable state or a positioned state.

6 Claims, 8 Drawing Sheets

U.S. PATENT DOCUMENTS

| | | | | |
|---|---|---|---|---|
| 7,334,840 | B2 * | 2/2008 | Deans et al. | 297/270.1 |
| 7,832,800 | B2 * | 11/2010 | Lo | 297/330 |
| 8,096,614 | B2 * | 1/2012 | Lin | 297/270.4 |
| 2002/0195852 | A1 * | 12/2002 | Tsai | 297/273 |
| 2007/0096522 | A1 * | 5/2007 | Bergeron | 297/270.1 |
| 2011/0148161 | A1 * | 6/2011 | Fontaine | 297/270.1 |
| 2011/0248536 | A1 * | 10/2011 | Lapointe | 297/273 |

* cited by examiner

ROCKING CHAIR

BACKGROUND OF THE INVENTION

1. Field of the Invention

The present invention relates to a rocking chair and, more particularly, to a leisure rocking chair providing stable rocking.

2. Description of the Related Art

Leisure chairs are common furniture for leisure at home. People can rest in the leisure chairs to recover from tiredness. Leisure chairs with rocking functions have been proposed. An example of leisure rocking chairs is shown in U.S. Pat. No. 7,090,295 and includes an oscillating base and a seat affixed to the base. The seat is provided with two downwardly projecting struts connected to lower oscillating sections at the lower ends. Each lower oscillating section is connected to an oscillating parallelogram formed by oscillating rods whereby the upper sections of the parallelogram are mounted inside the downwardly projecting struts at the bottom. The downwardly projecting struts are formed as a single component with a downwardly open U-shaped holding arc having flat lateral surfaces attached to the lower oscillating longitudinal sections. The upper sections are rotatably mounted inside the U-shaped holding arc as transversal carriers of a column affixed to a base plate. However, the weight of the seat is merely supported by the struts, and the seat is located above the struts, resulting in unstable rocking. Furthermore, the rocking chair has no positioning devices for adjusting the position of the seat, failing to provide the sitting comfort and causing limitation to use.

To adjust the rocking angle of the rocking chair, a cable positioning mechanism similar to that for bicycles has been proposed. Such a cable positioning mechanism includes a control end that can be easily held by a user. Through manual operation of the control end, a cable connected to the control end can be moved to disengage a locking portion engaged with a rocking mechanism, allowing adjustment of rocking angle. However, such a cable positioning mechanism is complicated and requires large force to operate, leading to inconvenient use as well as unstable locking effect.

BRIEF SUMMARY OF THE INVENTION

An objective of the present invention is to provide a rocking chair with enhanced support, stable rocking, and enhanced positioning.

A rocking chair according to the present invention includes a sitting mechanism, a fixed base, a rocking mechanism, and a positioning mechanism. The fixed base includes a base portion adapted to be located on the ground. The base portion includes front and rear sides spaced in a rocking direction. The fixed base further includes a connecting frame extending upright from the base portion. The connecting frame has a receiving space. The rocking mechanism is mounted in the receiving space. The rocking mechanism includes a bottom plate, a strut, and front and rear rocking members. The bottom plate includes front end and rear ends pivotably connected to the connecting frame. The strut extends upright from the bottom plate and has an upper end fixed to the sitting mechanism, allowing joint movement of the sitting mechanism and the rocking mechanism. The front rocking member includes an upper end pivotably connected to the connecting frame and a lower end pivotably connected to the front end of the bottom plate. The rear rocking member includes an upper end pivotably connected to the connecting frame and a lower end pivotably connected to the rear end of the bottom plate. The rocking mechanism is rockable in the receiving space in the rocking direction relative to the fixed base. The positioning mechanism controls the rocking mechanism to be in a rockable state or a positioned state.

Preferably, the connecting frame includes two parallel frames extending upright from the base portion. The frames are spaced in a width direction perpendicular to the rocking direction and defining the receiving space.

Preferably, the connecting frame further includes front and rear axles and front and rear shafts. Each frame includes front and rear ends each having a pivotal portion. The upper pivotal portion of the front rocking member is pivotably connected by the front shaft to the pivotal portions of the front ends of the frames. The lower pivotal portion of the front rocking member is pivotably connected by the front axle to the front end of the bottom plate. The upper pivotal portion of the rear rocking member is pivotably connected by the rear shaft to the pivotal portions of the rear ends of the frames. The lower pivotal portion of the rear rocking member is pivotably connected by the rear axle to the rear end of the bottom plate.

Preferably, the sitting mechanism includes a seat, a backrest, and two armrest. The armrests are connected to a connecting beam. The strut includes an upper end having a connecting portion fixed to the connecting beam.

Preferably, the positioning mechanism includes a positioning plate, first and second adjusting blocks, an adjusting rod, and a spring. The positioning plate is fixed to the connecting frame and includes a plurality of positioning holes spaced in the rocking direction. Each of the first and second adjusting blocks includes a central hole and an inclined face. The inclined faces of the first and second adjusting blocks are engageable with each other. The first adjusting block is mounted to the strut, and the second adjusting block is mounted to the adjusting rod. The adjusting rod extends through the central holes of the first and second adjusting blocks. A handle mounted to a first end of the adjusting rod, and a second end of the adjusting rod includes an engaging portion releasably engaged with one of the positioning holes. The adjusting rod further includes a stop. The spring is mounted on the adjusting rod and has two ends pressing against the stop and the strut, biasing the engaging portion of the adjusting rod to engage with one of the positioning holes.

Preferably, a sleeve is fixed to the strut and included an insertion hole through which the adjusting rod extends. The sleeve includes an end having a notch. The notch includes first and second stop edges spaced by 180°. The second adjusting block includes a through-hole. A bolt extends through the through-hole to mount the second adjusting block to the adjusting rod. The adjusting rod is rotatable through 180° to abut the bolt with one of the first and second stop edges and to engage or disengage the inclined face of the first adjusting block with or from the inclined face of the second adjusting block.

Other objectives, advantages, and novel features of the invention will become more apparent from the following detailed description when taken in conjunction with the accompanying drawings.

DETAILED DESCRIPTION OF THE INVENTION

Figure 1:
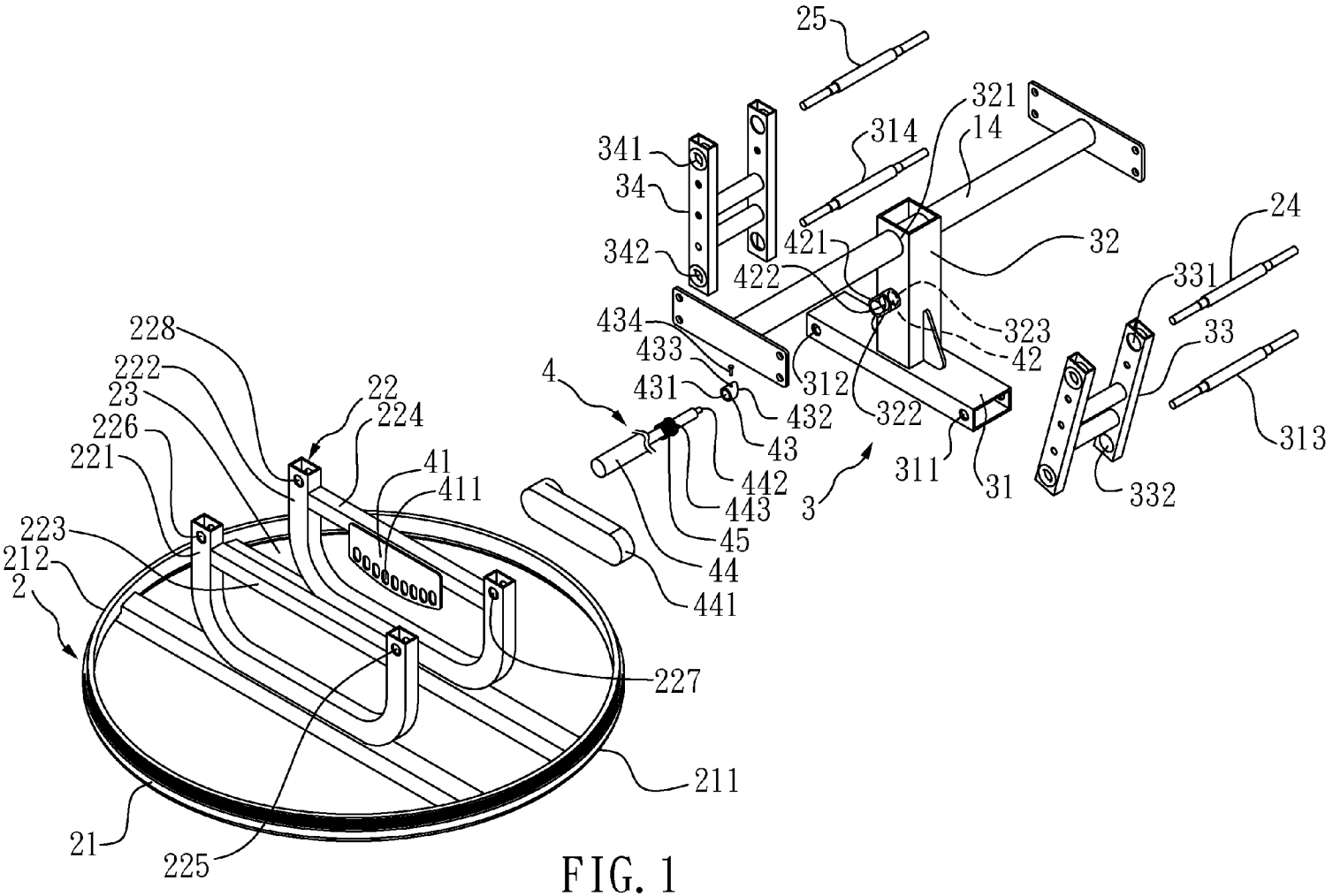
FIG. 1 shows an exploded, perspective view of a fixed base, a rocking mechanism, and a positioning mechanism of a rocking chair according to the present invention.
Figure 2:
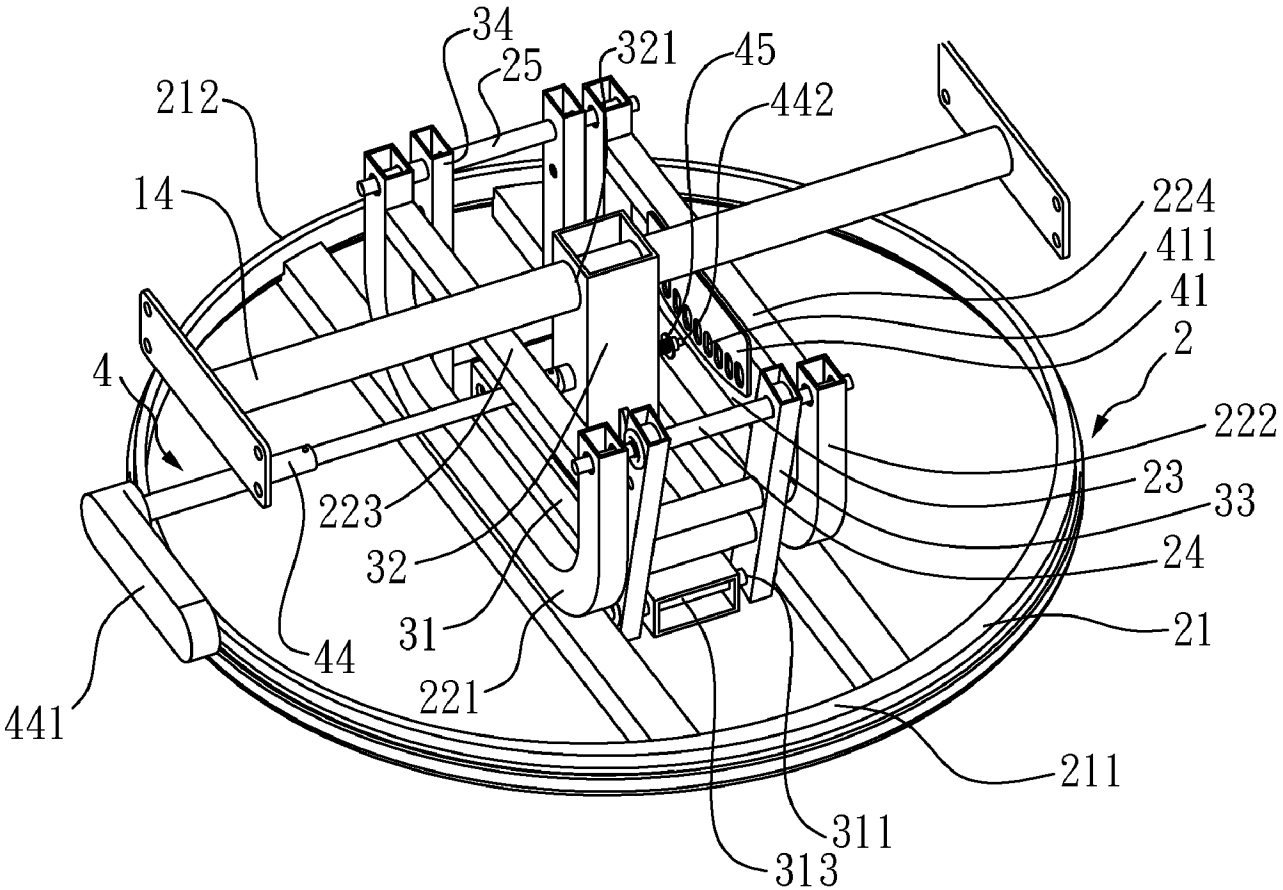
FIG. 2 shows a perspective view of the fixed base, the rocking mechanism, and the positioning mechanism of FIG. 1 after assembly.
Figure 3:
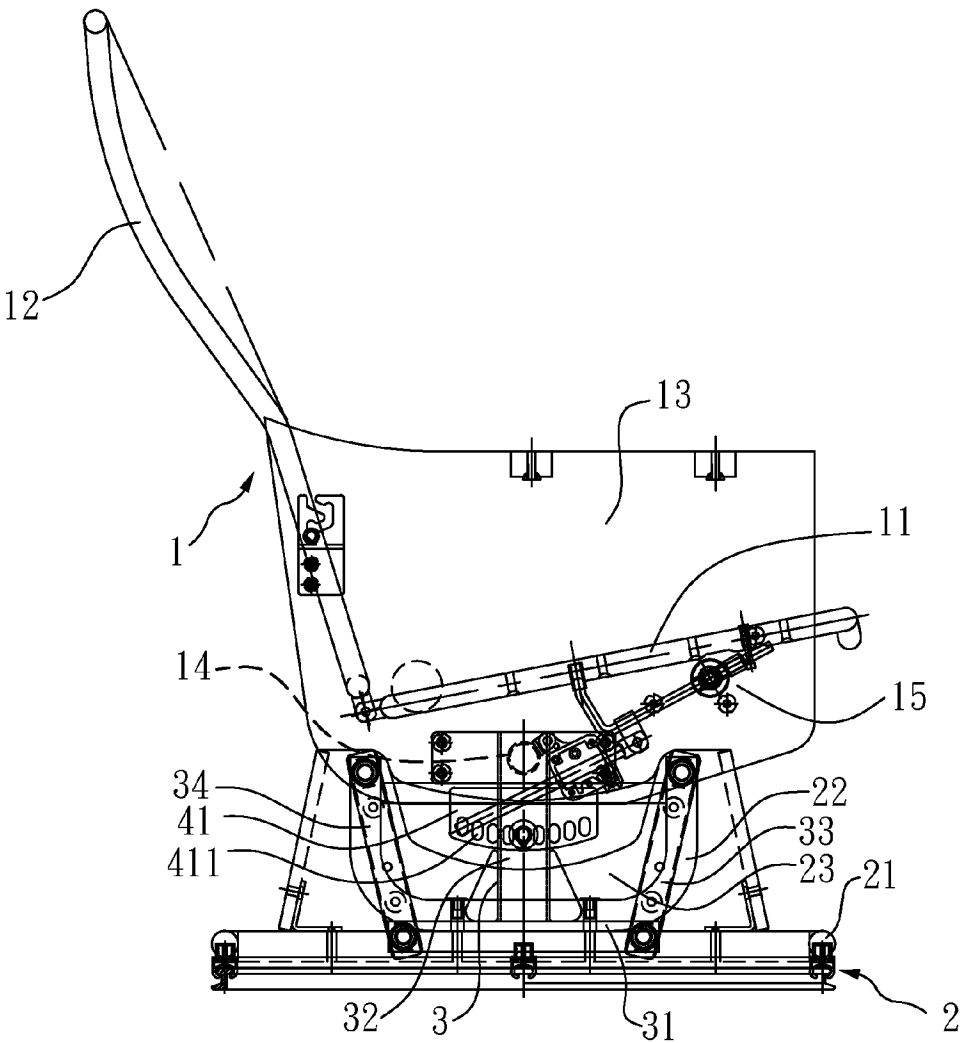
FIG. 3 shows a side view of the rocking chair according to the present invention.
Figure 4:
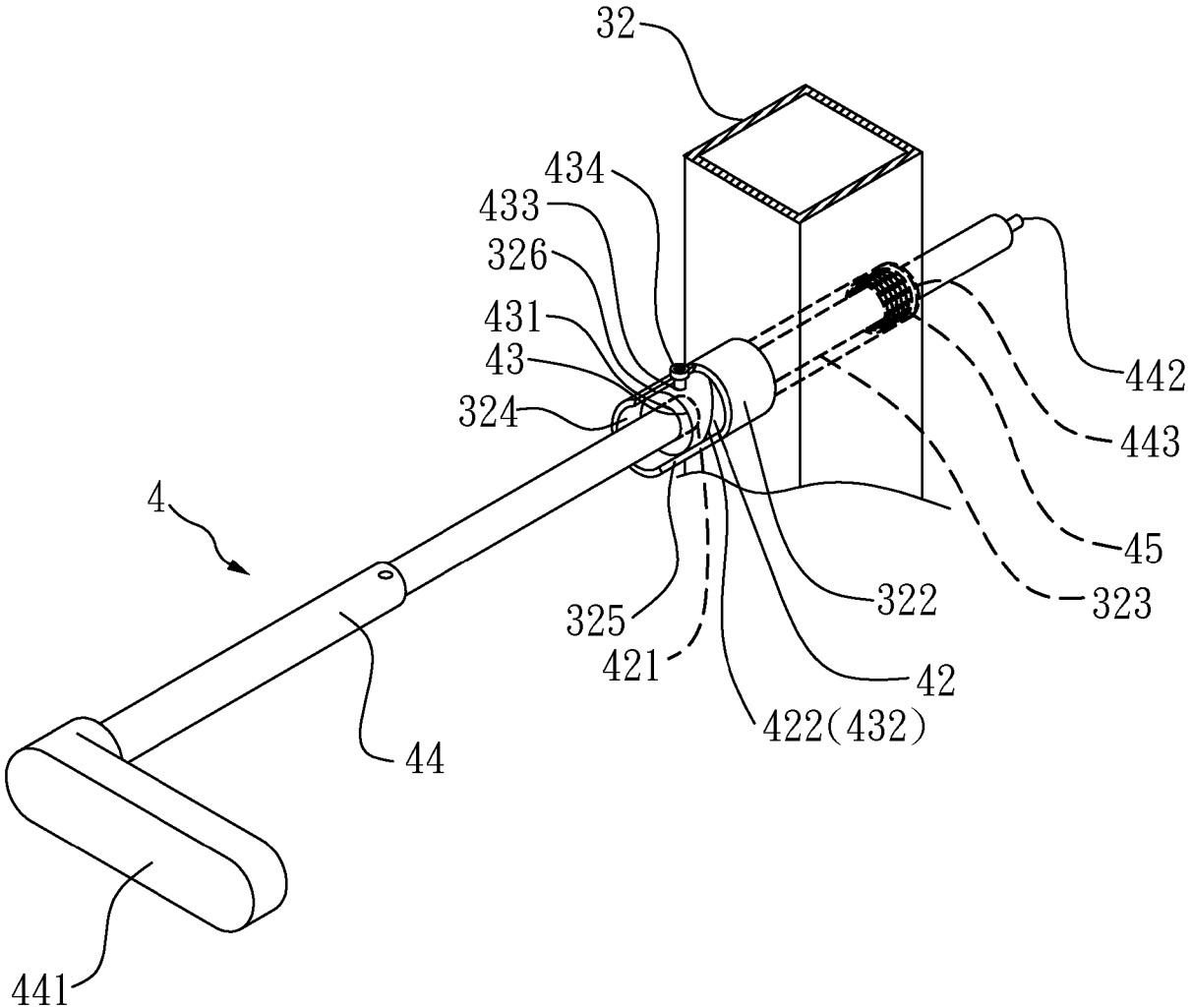
FIG. 4 shows a perspective view of the positioning mechanism of FIG. 1.
Figure 5:
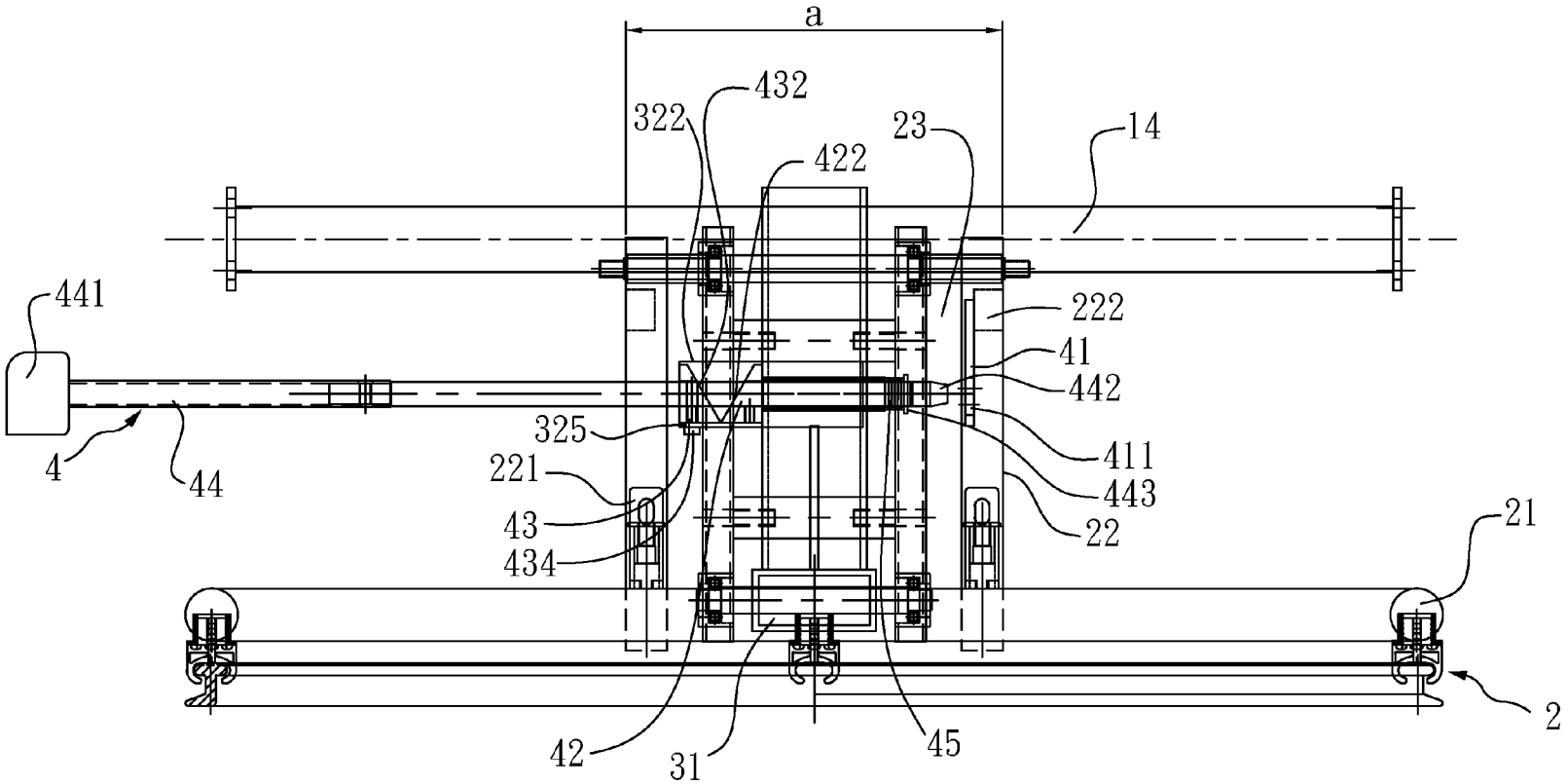
FIG. 5 shows a front view of the rocking chair according to the present invention with the rocking chair not positioned.

With reference to FIGS. 1-5, a rocking chair according to the present invention includes a sitting mechanism 1, a fixed base 2, a rocking mechanism 3, and a positioning mechanism 4. The sitting mechanism 1 includes a seat 11, a backrest 12, and two armrests 13. The backrest 12 is pivotably connected to the sat 11. An angle adjusting mechanism 15 is provided to adjust an angle between the seat 11 and the backrest 12. The armrests 13 are connected by a connecting beam 14 to the rocking mechanism 3. Thus, the armrests 13 and the rocking mechanism 3 move jointly.

The fixed base 2 includes a base portion 21 and a connecting frame 22. The base portion 21 is located on the ground and includes front and rear sides 211 and 212 spaced in a rocking direction (the sitting direction of a user). The connecting frame 22 includes two parallel frames 221 and 222 spaced in a width direction perpendicular to the rocking direction and extending upward from the base portion 21. A receiving space 23 is formed between the frames 221 and 222. Each frame 221, 222 includes a front, upper end having a pivotal portion 225, 227 for pivotal connection with a front shaft 24. Each frame 221, 222 further includes a rear, upper end having a pivotal portion 226, 228 for pivotal connection with a rear shaft 25. The frames 221 and 222 provide a longer width a (FIG. 5) for supporting purposes.

The rocking mechanism 3 is mounted in the receiving space 23 of the fixed base 2. The rocking mechanism 3 includes a bottom plate 31, a strut 342, and front and rear rocking members 33 and 34. The bottom plate 31 includes front and rear ends having front and rear pivotal portions 311 and 312 for pivotal connection with front and rear axles 313 and 314. The strut 32 extends upright from the bottom plate 31 and includes an upper end having a connecting portion 321 to which the connecting beam 14 of the sitting mechanism 1 is mounted. Thus, the sitting mechanism 1 and the rocking mechanism 3 move jointly. A sleeve 322 is fixed to the strut 32 and has an insertion hole 323. The sleeve 322 further includes an end having a notch 324. The notch 324 has two stop edges 325 and 326 spaced from each other by 180°. The front rocking member 33 includes upper and lower ends having upper and lower pivotal portions 331 and 332. The rear rocking member 34 includes upper and lower ends having upper and lower pivotal portions 341 and 342. The upper pivotal portion 331 of the front rocking member 33 is pivotably connected by the front shaft 24 to the front, upper pivotal portions 225 and 227 of the connecting frame 22. The lower pivotal portion 332 of the front rocking member 33 is pivotably connected by the front axle 313 to the front pivotal portion 311 of the bottom plate 31. The upper pivotal portion 341 of the rear rocking member 34 is pivotably connected by the rear shaft 25 to the rear, upper pivotal portions 226 and 228 of the connecting frame 22. The lower pivotal portion 342 of the rear rocking member 34 is pivotably connected by the rear axle 314 to the rear pivotal portion 312 of the bottom plate 31. Thus, the rocking mechanism 3 can rock forward and rearward in the rocking direction relative to the fixed base 2.

The positioning mechanism 4 includes a positioning plate 41, two adjusting blocks 42 and 43, an adjusting rod 44, and a spring 45. The positioning plate 41 is fixed to the connecting frame 22 and includes a plurality of positioning holes 411 spaced in the rocking direction. Each adjusting block 42 and 43 includes a central hole 421, 431 and an inclined face 422, 423. The inclined faces 422 and 423 can be complementarily engaged with each other. The adjusting block 42 is fixed in the notch 324 of the sleeve 322. The adjusting block 43 has a through-hole 433 through which a bolt 434 extends, fixing the adjusting block 43 to the adjusting rod 44. The adjusting rod 44 is extended through the central holes 421 and 431 of the adjusting blocks 42 and 43 and the insertion hole 323 of the sleeve 322. A handle 441 is mounted to an end of the adjusting rod 44. The other end of the adjusting rod 44 includes an engaging portion 442 releasably engaged with one of the positioning holes 411 of the positioning plate 41. The adjusting rod 44 further includes a stop 443. The spring 45 is mounted on the adjusting rod 44 and has two ends pressing against the stop 443 and the sleeve 322, biasing the engaging portion 441 of the adjusting rod 44 to engage with one of the positioning holes 411.

Figure 6:
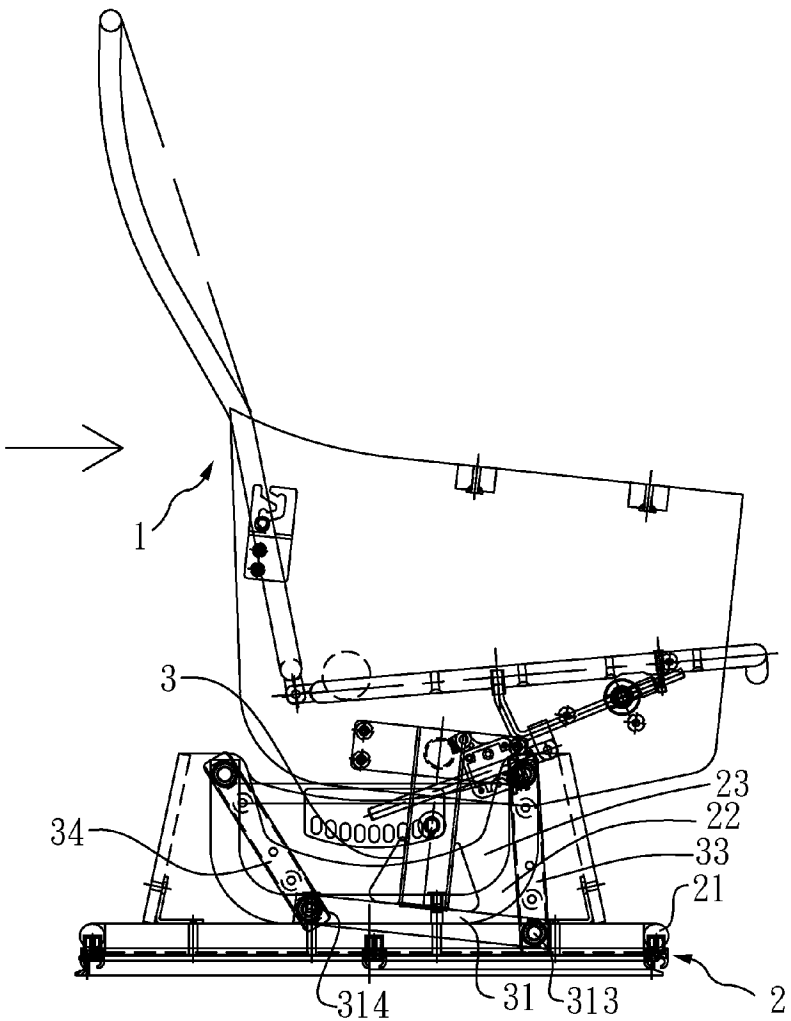
FIG. 6 shows a side view of the rocking chair according to the present invention with the rocking chair rocking forward.
Figure 7:
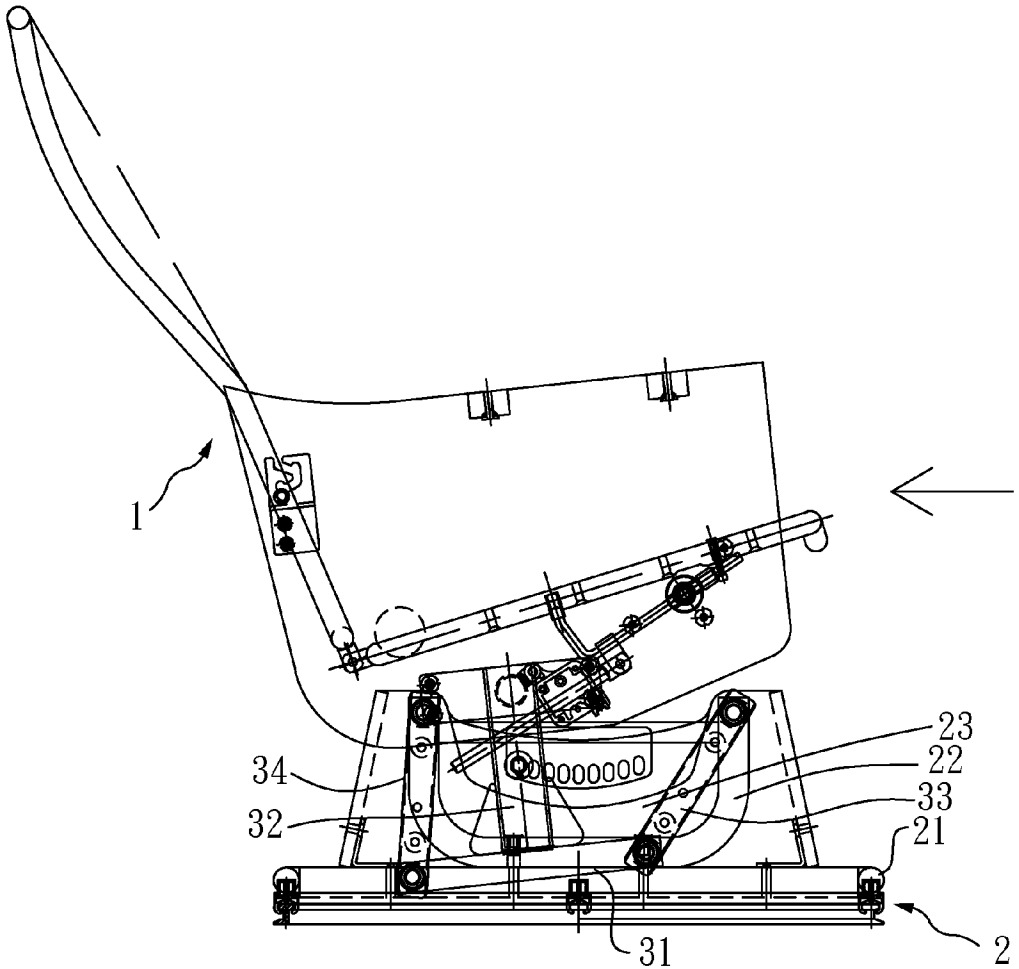
FIG. 7 shows a side view of the rocking chair according to the present invention with the rocking chair rocking rearward.

The adjusting rod 44 can be rotated to abut the bolt 434 against the stop edge 325 of the notch 323 of the sleeve 322 such that the inclined faces 422 and 432 of the adjusting blocks 42 and 43 are not aligned with each other and that the engaging portion 442 of the adjusting rod 42 is disengaged from the positioning holes 411. The spring 45 is compressed. In this state, the rocking mechanism 3 can rock forward and rearward in the rocking direction (FIGS. 6 and 7) relative to the fixed base 2. The frames 221 and 222 of the connecting frame 22 provide an increased supporting area to withstand the weight of the user sitting on the sitting mechanism 1, and the rocking mechanism 3 moves in the receiving space 23 of the connecting frame 22, providing enhanced support and stable rocking.

Figure 8:
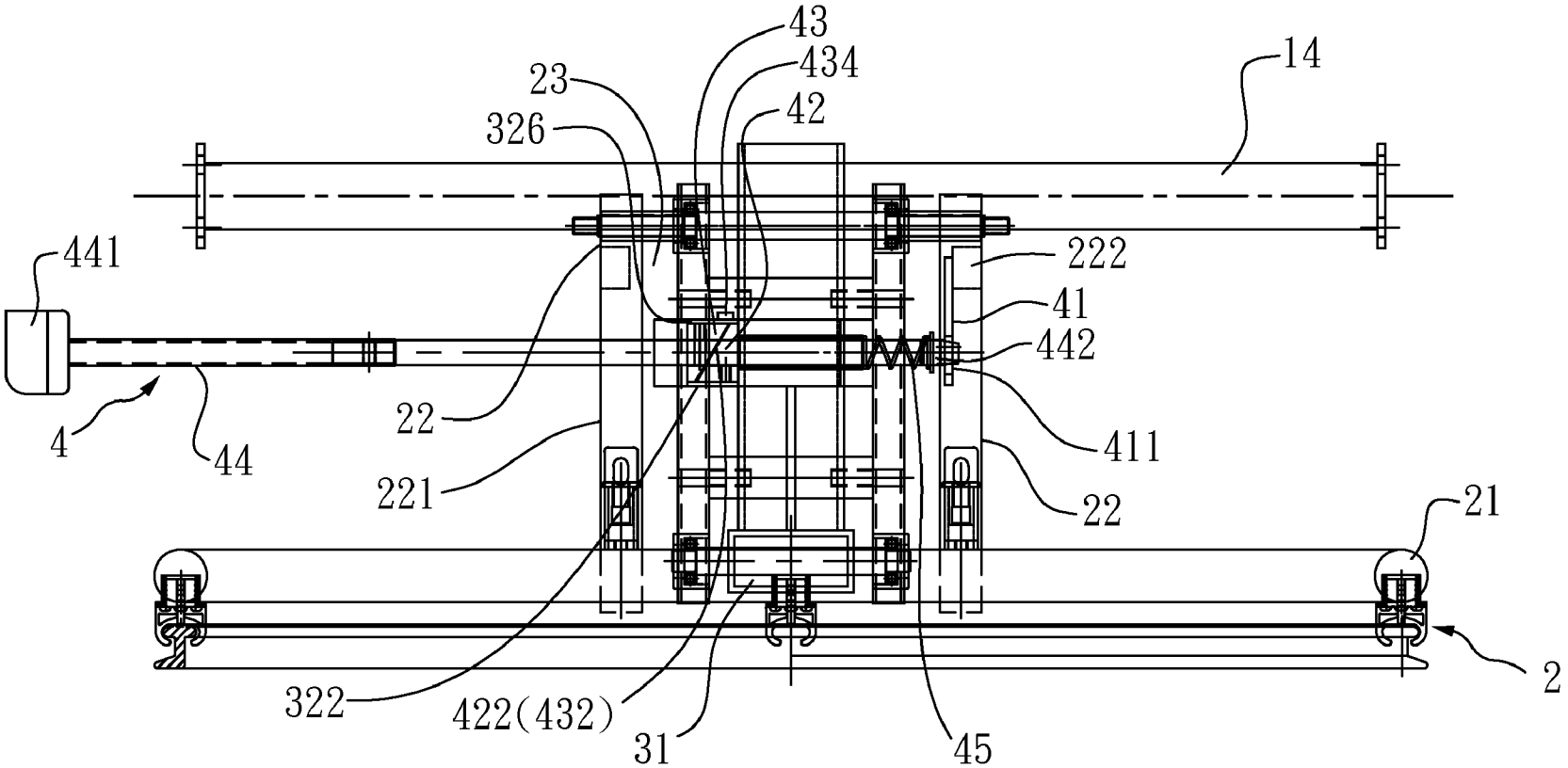
FIG. 8 shows a front view of the rocking chair according to the present invention with the rocking chair positioned.

With reference to FIG. 8, when the sitting mechanism 1 and the rocking mechanism 3 rock to a certain position, and the user intends to fix the rocking chair in this position, the adjusting rod 44 is rotated 180° such that the inclined faces 422 and 432 of the adjusting blocks 42 and 43 engage with each other and that the bolt 434 against the stop edge 326 of the notch 323 of the sleeve 322 to provide positioning effect. The adjusting rod 44 is moved under the returning force of the spring 45, engaging the engaging portion 442 with one of the positioning holes 441 aligned with the engaging portion 442, providing positioning stability and convenient use.

Although specific embodiments have been illustrated and described, numerous modifications and variations are still possible without departing from the essence of the invention. The scope of the invention is limited by the accompanying claims.

The invention claimed is:

1. A rocking chair comprising:

a sitting mechanism;

a fixed base including a base portion adapted to be located on a ground, with the base portion including front and rear sides spaced in a rocking direction, with the fixed base further including a connecting frame extending upright from the base portion, with the connecting frame having a receiving space;

a rocking mechanism mounted in the receiving space, with the rocking mechanism including a bottom plate, a strut, and front and rear rocking members, with the bottom plate including front end and rear ends pivotably connected to the connecting frame, with the strut extending upright from the bottom plate, with the strut having an upper end fixed to the sitting mechanism, allowing joint movement of the sitting mechanism and the rocking mechanism, with the front rocking member including an upper end pivotably connected to the connecting frame and a lower end pivotably connected to the front end of the bottom plate, with the rear rocking member including an upper end pivotably connected to the connecting frame and a lower end pivotably connected to the rear end of the bottom plate, with the rocking mechanism rockable in the receiving space in the rocking direction relative to the fixed base; and a positioning mechanism for controlling the rocking mechanism to be in a rockable state or a positioned state.

2. The rocking chair as claimed in claim 1, with the connecting frame including two parallel frames extending upright from the base portion, with the two frames spaced in a width direction perpendicular to the rocking direction and defining the receiving space.

3. The rocking chair as claimed in claim 1, with the connecting frame further including front and rear axles and front and rear shafts, with each of the two frames including front and rear ends each having a pivotal portion, with the upper pivotal portion of the front rocking member pivotably connected by the front shaft to the pivotal portions of the front ends of the two frames, with the lower pivotal portion of the front rocking member pivotably connected by the front axle to the front end of the bottom plate, with the upper pivotal portion of the rear rocking member pivotably connected by the rear shaft to the pivotal portions of the rear ends of the two frames, with the lower pivotal portion of the rear rocking member pivotably connected by the rear axle to the rear end of the bottom plate.

4. The rocking chair as claimed in claim 1, with the sitting mechanism including a seat, a backrest, and two armrest, with the armrests connected to a connecting beam, with the strut including an upper end having a connecting portion fixed to the connecting beam.

5. The rocking chair as claimed in claim 1, with the positioning mechanism including a positioning plate, first and second adjusting blocks, an adjusting rod, and a spring, with the positioning plate fixed to the connecting frame and including a plurality of positioning holes spaced in the rocking direction, with each of the first and second adjusting blocks including a central hole and an inclined face, with the inclined faces of the first and second adjusting blocks engageable with each other, with the first adjusting block mounted to the strut, with the second adjusting block mounted to the adjusting rod, with the adjusting rod extending through the central holes of the first and second adjusting blocks, with the adjusting rod including first and second ends, with a handle mounted to the first end of the adjusting rod, with the second end of the adjusting rod including an engaging portion releasably engaged with one of the plurality of positioning holes, with the adjusting rod further including a stop, with the spring mounted on the adjusting rod and having two ends pressing against the stop and the strut, biasing the engaging portion of the adjusting rod to engage with one of the plurality of positioning holes.

6. The rocking chair as claimed in claim 5, with a sleeve fixed to the strut and including an insertion hole, with the adjusting rod extending through the insertion hole, with the sleeve including an end having a notch, with the notch including first and second stop edges spaced by 180°, with the second adjusting block including a through-hole, with a bolt extending through the through-hole to mount the second adjusting block to the adjusting rod, with the adjusting rod rotatable through 180° to abut the bolt with one of the first and second stop edges and to engage or disengage the inclined face of the first adjusting block with or from the inclined face of the second adjusting block.

* * * * *